US005649551A

United States Patent [19]

Böttger

[11] Patent Number: 5,649,551

[45] Date of Patent: Jul. 22, 1997

[54] APPARATUS FOR TRANSFERRING A FLOW OF FIBROUS MATERIAL OF THE TOBACCO PROCESSING INDUSTRY FROM A PNEUMATIC BELT CONVEYOR ONTO A GARNITURE BELT FOR WEBS OF WRAPPING MATERIAL

[75] Inventor: Andreas Böttger, Hamburg, Germany

[73] Assignee: Hauni Maschinenbau AG, Hamburg, Germany

[21] Appl. No.: 725,143

[22] Filed: Oct. 2, 1996

[30] Foreign Application Priority Data

Nov. 23, 1995 [DE] Germany ..... 195 43 672.5

[51] Int. Cl.[6] ..... A24C 5/14; A24C 5/18

[52] U.S. Cl. ..... 131/84.1

[58] Field of Search ..... 131/84.1, 84.2, 131/108; 198/689.1

[56] References Cited

U.S. PATENT DOCUMENTS

| | | | |
|---|---|---|---|
| 4,721,119 | 1/1988 | Ludszeweit et al. . | |
| 5,072,742 | 12/1991 | Heitmann . | |
| 5,345,954 | 9/1994 | Dall'osso et al. | 131/84.1 X |
| 5,361,783 | 11/1994 | Herburg | 131/84.1 |
| 5,370,136 | 12/1994 | Dawson et al. | 131/84.1 |
| 5,398,702 | 3/1995 | Belvederi | 131/84.1 |
| 5,413,121 | 5/1995 | Dawson et al. | 131/84.1 |

FOREIGN PATENT DOCUMENTS

| | | |
|---|---|---|
| 1208063 | 10/1970 | United Kingdom . |
| 2254772 | 7/1994 | United Kingdom . |

*Primary Examiner*—Jennifer Bahr
*Attorney, Agent, or Firm*—Darby & Darby

[57] ABSTRACT

Apparatus for transferring a rod-like filler of fibrous material of the tobacco processing industry from the underside of a foraminous suction belt conveyor to the concave upper side of a running web of cigarette paper or other suitable wrapping material upstream of the station where the web is draped around the filler and downstream of the station where the fibrous material is showered against the foraminous belt conveyor has a so-called garniture belt conveyor which advances the web along a horizontal path, and a guide which compels an upstream portion of the foraminous belt conveyor to advance above and in at least substantial parallelism with the garniture belt conveyor. The guide causes a downstream portion of the foraminous belt conveyor to slope downwardly toward the garniture belt conveyor.

9 Claims, 1 Drawing Sheet

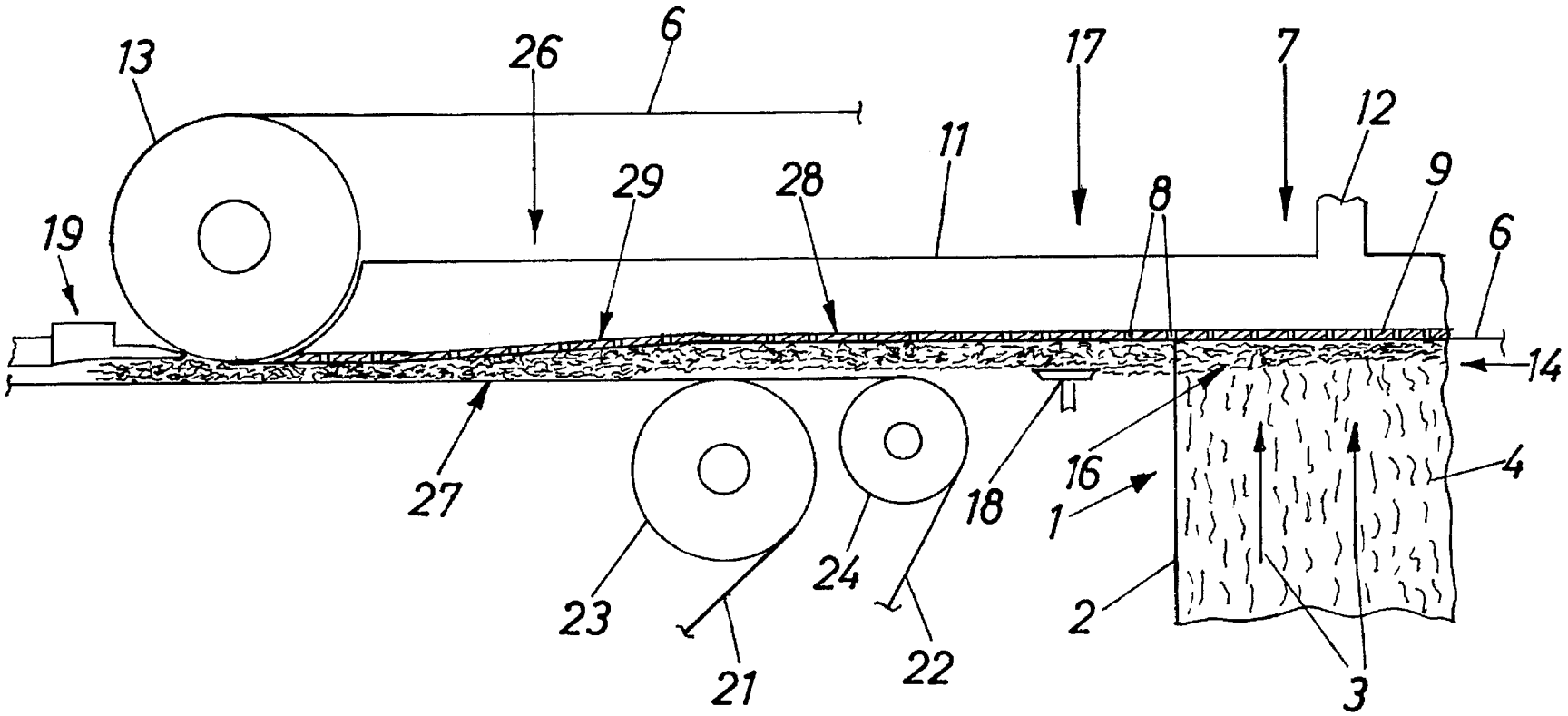
14
6
4
9
12
3
7
8
16
1
2
17
18
11
22
24
28
21
6
29
23
26
27
13
19

APPARATUS FOR TRANSFERRING A FLOW OF FIBROUS MATERIAL OF THE TOBACCO PROCESSING INDUSTRY FROM A PNEUMATIC BELT CONVEYOR ONTO A GARNITURE BELT FOR WEBS OF WRAPPING MATERIAL

BACKGROUND OF THE INVENTION

The invention relates to improvements in apparatus for manipulating flows of fibrous material in machines for the making of cigarettes, cigars, cigarillos, filter rod sections and/or other rod-shaped articles of the tobacco processing industry. More particularly, the invention relates to improvements in apparatus for transferring flows (e.g., streams or rod-shaped fillers) of fibrous material from an endless foraminous suction belt conveyor onto a running web of cigarette paper or other suitable wrapping material. Still more particularly, the invention relates to improvements in apparatus for manipulating a flow of fibrous material between a stream or flow building station and a stream or flow wrapping or confining station.

It is customary to direct a shower of fibrous material (e.g., shredded tobacco leaf laminae) against the underside of an elongated lower reach or stretch of a foraminous belt conveyor which cooperates with a suction chamber to attract the particles of tobacco and to thus build up a continuous stream or flow which is thereupon trimmed to remove the surplus and to thus form a substantially rod-like filler which is ready for draping into a running web of cigarette paper or other suitable wrapping material. Reference may be had, for example, to commonly owned U.S. Pat. No. 4,721,119 granted Jan. 26, 1988 to Ludszeweit et al., and to commonly owned U.S. Pat. No. 5,072,742 granted Dec. 17, 1991 to Heitmann. The disclosures of these patents are incorporated herein by reference.

OBJECTS OF THE INVENTION

An object of the invention is to provide a simple, compact and reliable apparatus which can transfer a continuous flow of fibrous material of the tobacco processing industry onto a running web of wrapping material and can be installed in existing production lines for the making of rod-shaped smokers' products as a superior substitute for heretofore known and used apparatus.

Another object of the invention is to provide a novel and improved guide for an endless foraminous belt conveyor which is utilized in the above outlined transferring apparatus.

A further object of the invention is to provide an apparatus which is less likely to crimp, tear and/or otherwise undesirably affect the appearance and/or the quality of wrapping material than heretofore known and used apparatus.

An additional object of the invention is to provide a machine or a production line which embodies the above outlined apparatus.

Still another object of the invention is to provide a novel and improved method of guiding a filler-carrying reach of an endless foraminous suction belt conveyor in apparatus for building, transporting and transferring rod-like fillers of tobacco, filter material or the like.

A further object of the invention is to provide an apparatus wherein the foraminous endless suction belt conveyor and the means for advancing a running web of wrapping material cooperate and are positioned relative to each other in a novel and improved way.

SUMMARY OF THE INVENTION

The invention is embodied in an apparatus for transferring a flow (e.g., a so-called filler) of fibrous material of the tobacco processing industry from one side of a foraminous belt conveyor to one side of a running web of wrapping material, e.g., for transferring a rod-like filler of tobacco particles from one side of a suction belt conveyor to one side of a running web of cigarette paper. The improved apparatus comprises means for advancing the web along a first path in a predetermined direction, and means for advancing and guiding the foraminous belt conveyor and the flow of fibrous material at the one side of the belt conveyor along a second path in the predetermined direction. The second path has an upstream portion which is at least substantially parallel with the first path, and a downstream portion which slopes toward the first path.

The first path is or can be at least substantially horizontal, and the second path is or can be located at a level above the first path.

The one side of the web can have a substantially concave outline in a plane which is normal to the predetermined direction. To this end, the means for advancing the web along the first path can comprise an endless flexible conveyor (e.g., a so-called garniture) having means for imparting to the one side of the web the shape of a trough.

The apparatus can further comprise means (e.g., a duct which conveys fibrous material from a lower level to an upper level) for supplying fibrous material to the one side of the foraminous belt conveyor upstream of the upstream portion of the second path (as seen in the predetermined direction).

The apparatus can further comprise, or it can form part of, means for draping the web around the fibrous material downstream of the downstream portion of the second path (again as seen in the predetermined direction).

In accordance with a presently preferred embodiment of the improved apparatus, the first path has an at least substantially horizontal portion which is located beneath the downstream portion of the second path. In such apparatus, the downstream portion of the second path slopes downwardly toward the first path.

The novel features which are considered as characteristic of the invention are set forth in particular in the appended claims. The improved apparatus itself, however, both as to its construction and its mode of operation, together with numerous additional important features and advantages thereof, will be best understood upon perusal of the following detailed description of certain presently preferred specific embodiments with reference to the accompanying drawings.

BRIEF DESCRIPTION OF THE DRAWINGS

The single FIGURE of the drawings is a fragmentary schematic partly elevational and partly vertical sectional view of an apparatus which embodies one form of the present invention.

DESCRIPTION OF PREFERRED EMBODIMENTS

The single FIGURE of the drawings shows a portion of a machine which can be utilized for the making of a continuous rod containing fibrous filter material for tobacco smoke or fragments of tobacco leaves, reconstituted tobacco and/or artificial tobacco. For the sake of simplicity, the apparatus will be assumed to be designed for the making of a continuous cigarette rod. The reference character 1 denotes conventional means for supplying fragments 4 (e.g., shreds) of tobacco leaf laminae to a stream or flow building station 7 at the underside of the lower reach of an endless foraminous section belt conveyor 6 which is driven (e.g., by the illustrated pulley 13) to advance the growing and fully grown flow or stream 16 in the direction indicated by an arrow 14. The supplying means 1 comprises a duct 2 wherein the fragments 4 are caused to rise in the direction indicated by arrows 3 to form a shower which is intercepted by successive increments of the underside of the lower reach of the belt conveyor 6. Such lower reach is caused to advance along the underside of a foraminous bottom wall 9 having suction ports 8 and forming part of a suction chamber 11 with an air outlet 12 connected to the suction side of a blower (not shown) or any other suitable suction generating device.

The fully grown stream or flow 16 is advanced past a conventional trimming or equalizing device 18 which removes the surplus of tobacco particles and thus converts the stream or flow 16 into a substantially rod-like filler which is ready to be draped into successive increments of a running web 22 of cigarette paper or any other suitable wrapping material. The trimming or equalizing station for the surplus removing device 18 is denoted by the character 17 and is or can be located immediately downstream of the duct 2.

The bottom wall 9 constitutes a guide for the lower reach of the foraminous belt conveyor 6 and cooperates in a novel and improved manner with an endless belt conveyor 21 (known as garniture) which serves to advance the web 22 along a substantially horizontal path 27 toward and into a wrapping mechanism 19 shown as being located immediately downstream of the illustrated pulley 13 for the belt conveyor 6. The transfer of successive increments of the running trimmed or equalized stream or flow 16 onto successive increments of the running web 22 takes place at a station 26. The web 22 is drawn off a bobbin or another suitable source of supply (not shown) and is trained over a pulley 24 upstream of a pulley 23 for the belt conveyor 21.

The belt conveyor 21 is guided and advanced in such a way that it imparts to the upper side of the web 22 at the station 26 a concave outline (as seen in a plane extending at right angles to the plane of the FIGURE and to the direction indicated by the arrow 14), i.e., that portion of the web 22 which advances past the station 26 can be said to constitute or resemble a trough. The manner in which an endless belt known as garniture can be guided to impart to a running web of cigarette paper or the like the shape of a trough is well known in the relevant art. Reference may be had, for example, to British patent specification No. 1,208,063 granted Oct. 7, 1970 to Keizer and/or to UK patent No. 2 254 772 B granted Jul. 27, 1994 to Belvederi et al.

In accordance with the invention, the path which the bottom wall or guide 9 defines for the lower reach of the endless foraminous belt conveyor 6 at the transfer station 26 includes a horizontal upstream portion 28 which is parallel with and overlies the adjacent upstream portion of the path 27 for the web 22, and a downstream portion 29 which slopes downwardly from the upstream portion 28 toward the path 27, all as seen in the direction of the arrow 14. This greatly reduces the likelihood of damage to the trough-shaped portion of the web 22 during and subsequent to the transfer of the rod-like filler of tobacco particles 4 onto its upper side. Furthermore, such configuration of the path (28+29) for the foraminous belt conveyor 6 at the station 26 contributes to more predictable conversion of the trough-shaped web 22 into a tubular envelope during advancement through the mechanism 19. As can be seen in the FIGURE, the slope of the downstream portion 29 of the path for the foraminous belt conveyor 6 at the station 26 need not be very pronounced and can be gradual; for example, it can begin at a level above the pulley 23 for the belt conveyor 21 and can terminate ahead or upstream of the pulley 13 for the belt conveyor 6. The lower reach of the belt conveyor 6 is attracted to the guide 9 by suction in the chamber 11.

Another advantage of the improved apparatus is that it can be readily installed in, incorporated into or combined with existing machines for the making of rod-shaped smokers' products. Thus, a suction chamber 11 employing a bottom wall or guide 9 of the type shown in the FIGURE can be readily installed in existing cigarette rod making or analogous machines of the tobacco processing industry. Such bottom wall can readily cooperate with and can find room next to the adjacent component parts of cigarette rod making and analogous machines.

The guide 9 induces that portion of the belt conveyor 6 which is located at the station 26 to cooperate with the trough-shaped portion of the web 22 in order to establish an elongated funnel-shaped structure for reliable and predictable guidance of successive increments of the trimmed or equalized flow or stream 16 toward and into the wrapping mechanism 19. It has been found that such mode of guiding the trimmed flow reduces the likelihood of crimping, folding and/or other undesirable deformation of the web 22 during conversion into an envelope forming part of a continuous cigarette rod which is ready to be subdivided into cigarettes of unit length or multiple unit length immediately downstream of the wrapping mechanism 19.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making and wrapping flows of fibrous material of the tobacco processing industry and, therefore, such adaptations should and are intended to be comprehended within the meaning and range of equivalence of the appended claims.

What is claimed is:

1. Apparatus for transferring a flow of fibrous material of the tobacco processing industry from one side of a foraminous belt conveyor to one side of a running web of wrapping material, comprising means for advancing the web along a first path in a predetermined direction; and means for advancing and guiding the foraminous belt conveyor and the flow of fibrous material along a second path in said predetermined direction, said second path having an upstream portion which is at least substantially parallel with said first path and a downstream portion which slopes toward said first path.

2. The apparatus of claim 1, wherein said first path is at least substantially horizontal.

3. The apparatus of claim 1, wherein said second path is located at a level above said first path.

4. The apparatus of claim 1, wherein said one side of the web has a substantially concave outline in a plane extending at right angles to said direction.

5. The apparatus of claim 1, wherein said means for advancing the web along said first path comprises an endless flexible conveyor having means for imparting to the one side of the web the shape of a trough.

6. The apparatus of claim 1, further comprising means for supplying fibrous material to the one side of said foraminous belt conveyor upstream of said upstream portion of said second path.

7. The apparatus of claim 1, further comprising means for draping the web around the fibrous material downstream of said downstream portion of said second path.

8. The apparatus of claim 1, wherein said first path has a substantially horizontal portion beneath said downstream portion of said second path.

9. The apparatus of claim 1, wherein said downstream portion of said second path slopes downwardly toward said first path.

* * * * *